US009404338B2

(12) United States Patent
James et al.

(10) Patent No.: US 9,404,338 B2
(45) Date of Patent: Aug. 2, 2016

(54) METHODS AND APPARATUS FOR IMPROVED CEMENT PLUG PLACEMENT

(75) Inventors: Simon James, Le Plessis Robinson (FR); Bernard Piot, Paris (FR); Michael Montgomery, Sugar Land, TX (US); Gérard Daccord, Vauhallan (FR); Radovan Rolovic, Sugar Land, TX (US); Mathew Samuel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 892 days.

(21) Appl. No.: 13/124,153

(22) PCT Filed: Oct. 12, 2009

(86) PCT No.: PCT/EP2009/007385

§ 371 (c)(1),
(2), (4) Date: Sep. 21, 2011

(87) PCT Pub. No.: WO2010/046050

PCT Pub. Date: Apr. 29, 2010

(65) Prior Publication Data

US 2012/0000655 A1 Jan. 5, 2012

(30) Foreign Application Priority Data

Oct. 20, 2008 (EP) ..... 08167050

(51) Int. Cl.
*E21B 33/13* (2006.01)
*E21B 47/00* (2012.01)
(Continued)

(52) U.S. Cl.
CPC ..... *E21B 33/13* (2013.01); *E21B 47/0005* (2013.01); *E21B 47/06* (2013.01); *E21B 47/08* (2013.01)

(58) Field of Classification Search
CPC ..... E21B 47/00; E21B 47/0005; E21B 47/01; E21B 47/06
USPC ..... 166/250.14, 250.01, 285, 290, 177.4
See application file for complete search history.

(56) References Cited

U.S. PATENT DOCUMENTS 4,124,070 A 11/1978 King et al.
4,571,993 A * 2/1986 St. Onge ..... 73/152.31
(Continued)

FOREIGN PATENT DOCUMENTS

EP 2177712 4/2010
EP 2177713 4/2010
(Continued)

OTHER PUBLICATIONS

International Search Report for the equivalent PCT patent application No. EP2009/007385 issued on Jul. 28, 2011.
(Continued)

*Primary Examiner* — Brad Harcourt
(74) *Attorney, Agent, or Firm* — Michael L. Flynn; Rachel Greene; Tim Curington

(57) ABSTRACT

A method and apparatus for making real-time measurements of downhole properties during cement plug placement. A wired placement conduit is lowered downhole releasing a sensor package. The sensor package is capable of measuring downhole properties in real-time in the period while the cement plug sets.

20 Claims, 7 Drawing Sheets

(51) Int. Cl.
*E21B 47/06* (2012.01)
*E21B 47/08* (2012.01)

(56) References Cited

U.S. PATENT DOCUMENTS

| | | | | |
|---|---|---|---|---|
| 5,036,916 | A | 8/1991 | Bennett | |
| 5,315,291 | A | 5/1994 | Furr | |
| 5,409,071 | A | 4/1995 | Wellington et al. | |
| 5,448,227 | A | 9/1995 | Orban et al. | |
| 5,762,149 | A | 6/1998 | Donovan et al. | |
| 5,967,231 | A | 10/1999 | Laurel et al. | |
| 6,213,201 | B1 | 4/2001 | Renkis | |
| 6,230,800 | B1 * | 5/2001 | Bryant | 166/250.01 |
| 6,257,332 | B1 | 7/2001 | Vidrine et al. | |
| 6,629,564 | B1 * | 10/2003 | Ramakrishnan et al. | 166/250.07 |
| 7,019,665 | B2 | 3/2006 | Hall et al. | |
| 2002/0104653 | A1 | 8/2002 | Hosie et al. | |
| 2002/0195247 | A1 | 12/2002 | Ciglenec et al. | |
| 2003/0001753 | A1 | 1/2003 | Cernocky et al. | |
| 2003/0075324 | A1 | 4/2003 | Dusterhoft et al. | |
| 2004/0045714 | A1 | 3/2004 | McGavern et al. | |
| 2004/0047534 | A1 | 3/2004 | Shah et al. | |
| 2004/0069488 | A1 * | 4/2004 | Chaplin et al. | 166/254.2 |
| 2004/0139791 | A1 | 7/2004 | Johansen | |
| 2004/0206511 | A1 | 10/2004 | Tilton et al. | |
| 2004/0211443 | A1 | 10/2004 | Latiolais et al. | |
| 2006/0102336 | A1 | 5/2006 | Campbell | |
| 2006/0131014 | A1 * | 6/2006 | Huang et al. | 166/250.07 |
| 2006/0249307 | A1 | 11/2006 | Ritter et al. | |

FOREIGN PATENT DOCUMENTS

| | | |
|---|---|---|
| GB | 2413814 | 11/2005 |
| GB | 2476205 | 6/2011 |
| GB | 2476206 | 6/2011 |
| GB | 2477235 A | 7/2011 |
| WO | 01/07754 | 2/2001 |
| WO | 02/059458 | 8/2002 |
| WO | 2007/061932 | 5/2007 |

OTHER PUBLICATIONS

Examination report from the equivalent GB patent application number of 1105723.9 issued on Apr. 26, 2012.
Extended European Search Report issued in related EP Application No. 08167050.7, May 25, 2009, 8 Pages.
Partial European Search Report issued in related EP Application No. 08167050.7, Mar. 17, 2009, 4 pages.
Examination Report under Section 18(3) issued in related GB Application No. 1105749.4, May 18, 2012, 2 pages.
Notification of Grant issued in related GB Application No. 1105749.4, Sep. 11, 2012, 2 pages.
International Search Report and Written Opinion issued in related International Application No. PCT/EP2009/007061, Feb. 5, 2010, 11 pages.

* cited by examiner

METHODS AND APPARATUS FOR IMPROVED CEMENT PLUG PLACEMENT

TECHNICAL FIELD

This invention relates to a method and apparatus for use during cement plug placement operations of the type encountered in wells in the oil and gas industry. In particular, the invention relates to methods using instrumented pipes and downhole sensors.

BACKGROUND ART

Cement plugs are placed in wellbores for a variety of reasons; for curing wellbore instability or losses, plugging a wellbore or a portion of it, abandoning a wellbore or a section of it, providing a base for initiating a deviation or kick-off and more. Cement plugs are constructed by pumping a relatively small amount of cement slurry down a drill pipe where it later sets solid.

FIG. 1 shows a section of a well in which a cement plug is being set. The well 10 has a viscous pill 12 set in the well 10 at the bottom of the desired plug location. The end of a drill pipe 14 is then positioned just above the pill 12 and cement 16 is pumped down the drill pipe 14 into the well to form the plug 18 on the pill 12. As the plug builds up, the drill pipe is pulled back so that it does not remain in the plug 18 when it sets. Once all of the cement has been pumped into the well 10 and the plug 18 has formed, the drill pipe 14 can be withdrawn and other operations continued.

Drilling operations resume once the cement plug has set and developed enough strength to fulfil its objective, for example to initiate side tracking or to plug conductive fractures. There is great uncertainty however about when it is safe to resume drilling operations, to mitigate the risk of resuming drilling operations too soon, it is common practice to wait extra time, typically 24 hours.

Achieving proper placement of the cement plug presents a challenge as does uncertainty in the downhole temperature; frequently too much time is allowed for the cement plug to become set before an attempt to continue well operations is made.

A further problem is the risk of contamination, which leads to the cement not setting in the desired period of time and not achieving the required strength. The cement slurry may initially become contaminated whilst being pumped into the drill pipe and later when being jetted in the underlying drilling fluid. Some contamination also occurs in the drill pipe or casing annulus as the displacement of the drilling fluid is seldom perfect as the drill pipe is not centralized and some mud is trapped on the low or narrow side.

Another problem is cement plug slumping into the lower part of the well as it is usually denser than the drilling fluid. Frequently a viscous pill is placed to combat this. However frequently the plug does not have sufficient viscosity when placed and therefore does not provide support for the cement allowing the cement to slump to the bottom of the well leading to a failed plug.

This invention seeks to overcome many of the challenges highlighted above by providing real-time measurements of wellbore properties during cement plug placement.

DISCLOSURE OF THE INVENTION

A first aspect of the invention provides an apparatus for placing a cement plug in a well, comprising:

- a pipe for delivering a cement slurry to a predetermined location in the well to be plugged;
- at least one sensor located at a lower end of the pipe and operable to measure parameters in the well at the predetermined location; and
- an operating system located at the surface for receiving output signals from the sensor;

wherein the sensor is configured to measure at least one parameter relevant to cement plug placement and is connected to the operating system by means of a cable.

Preferably, the sensor comprises differential pressure sensor, for example a distributed differential pressure sensor for measuring pressure in the annulus outside the pipe in the well to evaluate the density of the fluids therein, or for measuring the difference in pressure between the inside of the pipe and annulus outside the pipe in the well.

A particularly preferred embodiment of the invention comprises a temperature sensor.

Particularly when the sensor is a temperature sensor, the apparatus can comprise a sensor package that is detachable from the pipe so as to remain at the predetermined location in the well and houses a sensor cable which can be withdrawn to connect the sensor to the operating system at the surface. The sensor cable can be connected to the pipe such that withdrawal of the pipe from the well causes the sensor cable to be withdrawn from the sensor package. The sensor cable can also be connected to a cable extending along the pipe to the operating system at the surface.

The apparatus preferably further comprises a release mechanism by which the sensor package is held in the pipe, the mechanism being operable by means of a body that can be pumped through the pipe to detach the sensor package on contact with the mechanism.

An anchoring system can be provided for securing the sensor package in position in the well after it is detached from the pipe.

A second aspect of the invention provides method of placing a cement plug in a well, comprising:

- providing a pipe for delivery of the cement plug with a sensor at its end;
- introducing the pipe into the well such that its end is at a predetermined location for placement of the plug;
- operating the sensor to measure at least one parameter relevant to cement plug placement and/or to measure parameters in the well at the predetermined location; and
- sending output signals from the sensor to an operating system located at the surface by means of a cable.

The step of operating the sensor comprises obtaining a differential pressure measurement in the fluids in the well in region of predetermined location.

The step of obtaining differential pressure measurements can comprise making a distributed differential pressure measurement in the annulus in the well outside the pipe to determine the density of fluids in the annulus; or measuring the pressure difference between the inside and the outside of the pipe when located in the well.

When the sensor comprises a sensor package housing a sensor cable which can be withdrawn to connect the sensor to the operating system at the surface, the method can further comprise detaching the sensor package from the pipe so that it remains at the predetermined location in the well, and withdrawing the pipe.

When the sensor cable is connected to the pipe, the step of withdrawing the pipe from the well acts to withdraw the sensor cable from the sensor package.

The sensor cable can be connected to a cable extending along the pipe to the operating system at the surface.

In a preferred embodiment, the sensor package is held in the pipe by a release mechanism, the method comprising pumping a body through the pipe to contact the mechanism to detach the sensor package.

The sensor package can also comprise an anchoring system, the method comprising securing the sensor package in position in the well after it is detached from the pipe by operating the anchoring system.

The method according to the second aspect of the invention is preferably performed using an apparatus according to the first aspect of the invention.

The cement can comprise Portland cement, magnesium oxychloride cement, epoxy resins, geopolymers, etc. Other plugging material might be used.

Further aspects of the invention will be apparent from the following description.

MODE(S) FOR CARRYING OUT THE INVENTION

Figure 1:
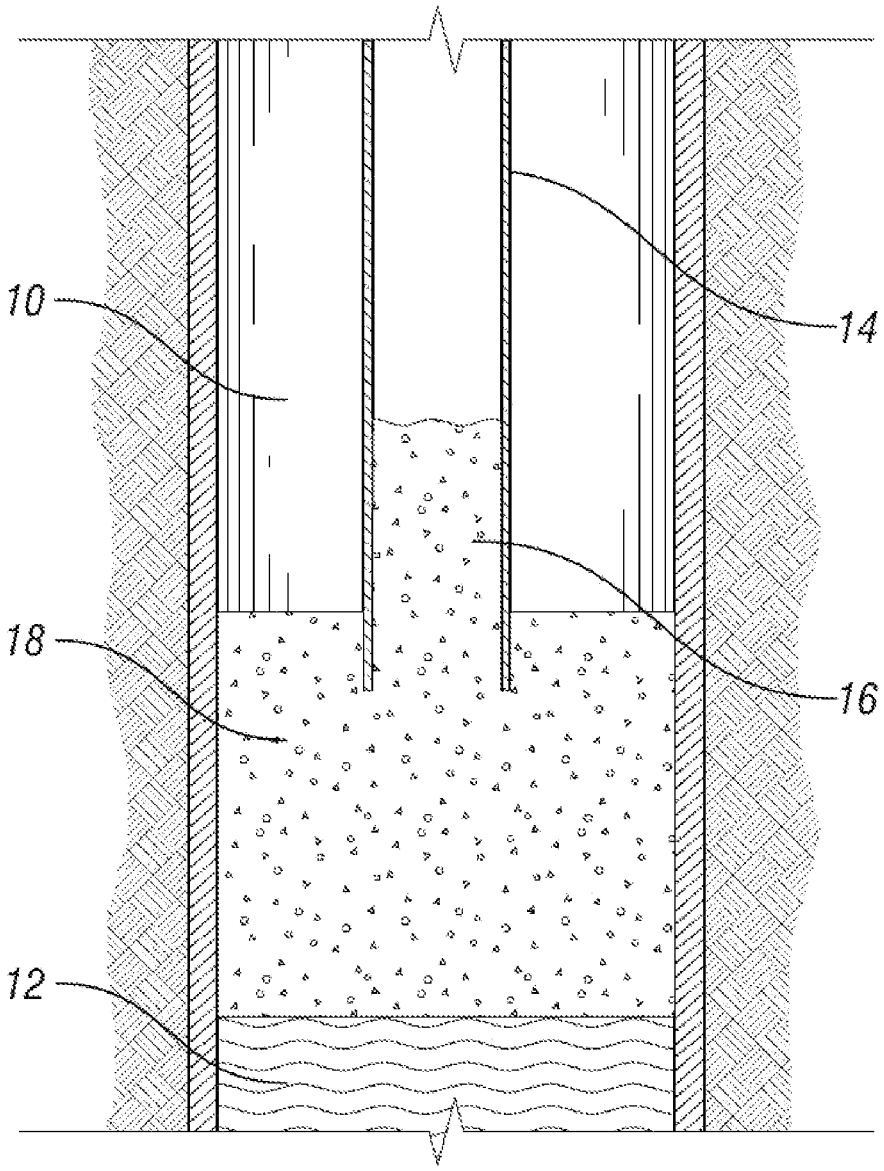
PRIOR ART Figure 1
FIG. 1 shows a prior art cement plug placement operation.
Figure 2:
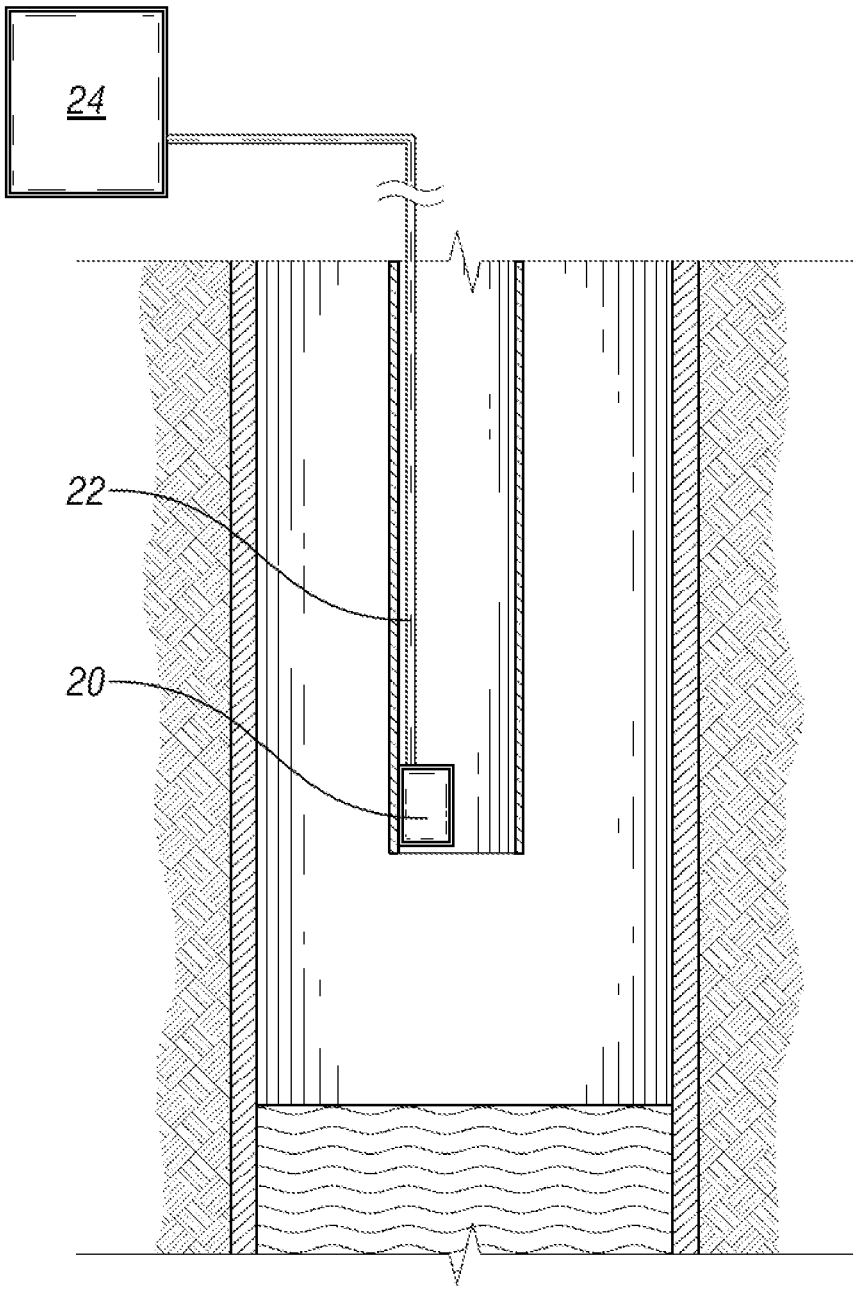
FIG. 2 shows an embodiment of the invention.

FIG. 2 shows a first embodiment of the invention, in which the lower end of the drill pipe 14 is provided with a downhole measurement package 20 comprising one or more sensors for measuring parameters in the well. The sensor package is connected back to the surface by means of a wire or cable 22. The wire or cable 22 can be run along the inside or outside of the drill pipe 14, and connects to an operating system 24 at the surface. The cable 22 need not be continuous, wireless communication systems can be provided for at least part of the connection to the surface such as at pipe joints (see U.S. Pat. No. 7,019,665). The sensors in the downhole measurement package can measure various parameters.

A temperature measurement can give an idea of how long to wait on cement. Sensitivity tests on the cement thickening time beforehand will lead to optimised waiting time.

A downhole viscosity measurement can allow the quality of the viscous plug to be evaluated. If it is insufficient a second viscous pill can be placed prior to placing cement, thus minimising the risk of slumping.

A distributed differential pressure measurement in the annulus can allow the fluid density in the annulus to be determined and if there is sufficient density difference between the fluids (spacer and cement/spacer and mud) it will be possible to qualitatively determine the degree of contamination of one fluid by another. If the contamination is too high, the decision can be taken to redo the plug immediately instead of waiting for the cement to set.

Other potential methods to determine contamination include pH measurements to assess contamination between spacer and cement and resistivity measurements to assess contamination between non-aqueous drilling fluids and spacer.

A differential pressure measurement between the inside and the outside of drill pipe 14 can indicate if the operation is following plan. A placement model of the plug allows calculation of the ideal dp as a function of job time. This can allow real time matching and evaluation of the job. Specifically if the same fluid is lying both inside and outside the drill pipe 14 at the depth of the DP measurement, no differential pressure will be measured; when a fluid interface arrives at the level of one pressure port—either inside or outside the drill-pipe—a pressure difference will be measured that is a function of the fluid densities; the pressure difference will increase as the pipe is pulled out.

Once the cement plug is placed correctly a temperature (or other) probe can be dropped into the cement as the drill pipe 14 is being pulled out. This can be connected via thin conductor or fibre optic to the wired pipe 14. The temperature monitor can allow indication of cement setting and pull out at the earliest time. This is particularly applicable to wells where the pipe is not pulled out on a routine basis during the setting.

A further embodiment of the invention provides a method of optimising cement plug placement by use of a wired placement conduit. A sensor package is deployed into the cement plug while in its liquid state prior to setting to take measurements of down hole properties. The method comprises assembly and deployment of the wired placement conduit which permits the correct placement of the sensor package and the unrolling of the communication wire and deployment of the slurry placement device which activates the release of the sensor package. Alternatively, the wire can be coiled on the conduit/drill pipe, from which it would unroll as the pipe is withdrawn.

The wired placement conduit is assembled on the surface prior to deployment. The sensor package and communication wire rolled as a bobbin are subsequently fastened to the lower end of the wired placement conduit. The wired placement conduit is lowered downhole prior to the cement slurry being pumped.

The slurry placement device is launched from the surface through the wired placement conduit thus activating the release of the sensor package. The release of the sensor package generates a pressure pulse. The wired placement conduit is retracted to the surface in response to the pressure pulse. The wired placement conduit may be partially retracted at a distance sufficient to ensure that the end is clear of the setting material. The communication wire is unrolled to the surface in response to the pressure pulse.

The sensor package is capable of measuring downhole properties in a similar manner to that described above. These include but are not limited to; temperature, viscosity, density, pH, resistivity measurements, differential pressure, elastic modulus and acoustic impedance. The sensor package may comprise multiple distributed sensors along the cement plug length. The data obtained from the sensor package can be used to manage the operation. For example, a viscous pill may be used in response to obtaining a low viscosity measurement indicative of slumping.

The sensor package may be attached to the well at the desired depth by a securing device. The securing device may comprise arms which permit contact with the well walls.

The wired pipe may comprise a drill string. In an alternative embodiment the wired pipe may comprise coiled tubing. Devices located on the wired placement conduit permit the measurement of the hole diameter. Sonic measurements may be taken to determine hole diameter. Alternatively calipers may be incorporated to measure hole diameter.

The communication wire may comprise a fibre optic cable and/or an electrical cable.

This invention provides a method and apparatus for deploying sensors into the liquid cement plug immediately following its placement and until it is almost set. As the material evolves with time, an operator can follow in real time its actual properties. This enables the operator to make informed decisions, based on these measured properties, of when it is possible to resume drilling operations. The amount of unproductive time is minimised.

Figure 3:
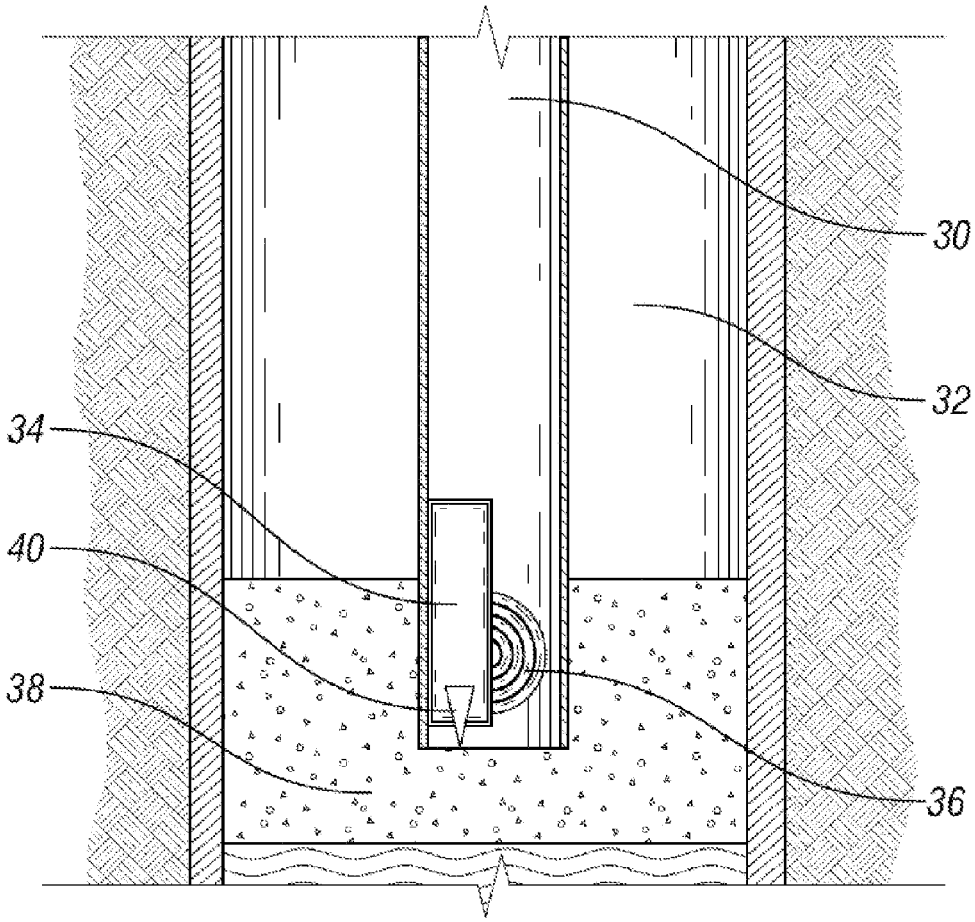
FIG. 3 shows a further embodiment of the invention being lowered downhole.

FIG. 3 shows the wired placement conduit 30 being deployed down the wellbore 32. Prior to the wired placement conduit being lowered downhole it is assembled at the surface with the sensor package 34 and communication wire 36 rolled as a bobbin fastened to the lower end of the wired pipe 30. The wired placement conduit may be either a drill string or coiled tubing. The wired placement conduit is lowered into the hole 32 and the cement slurry is pumped. Once the cement plug 38 is in place, the slurry placement device 40 is launched from the surface through the wired placement conduit. The slurry placement device may comprise a dart, ball or other similar device. Upon reaching the end of the wired placement conduit 30, the slurry placement device 40 hits a seat which activates the release of the sensor package. 34 A pressure pulse may be generated and received at the surface providing a positive indication of the release of the sensor package. 34

Figure 4:
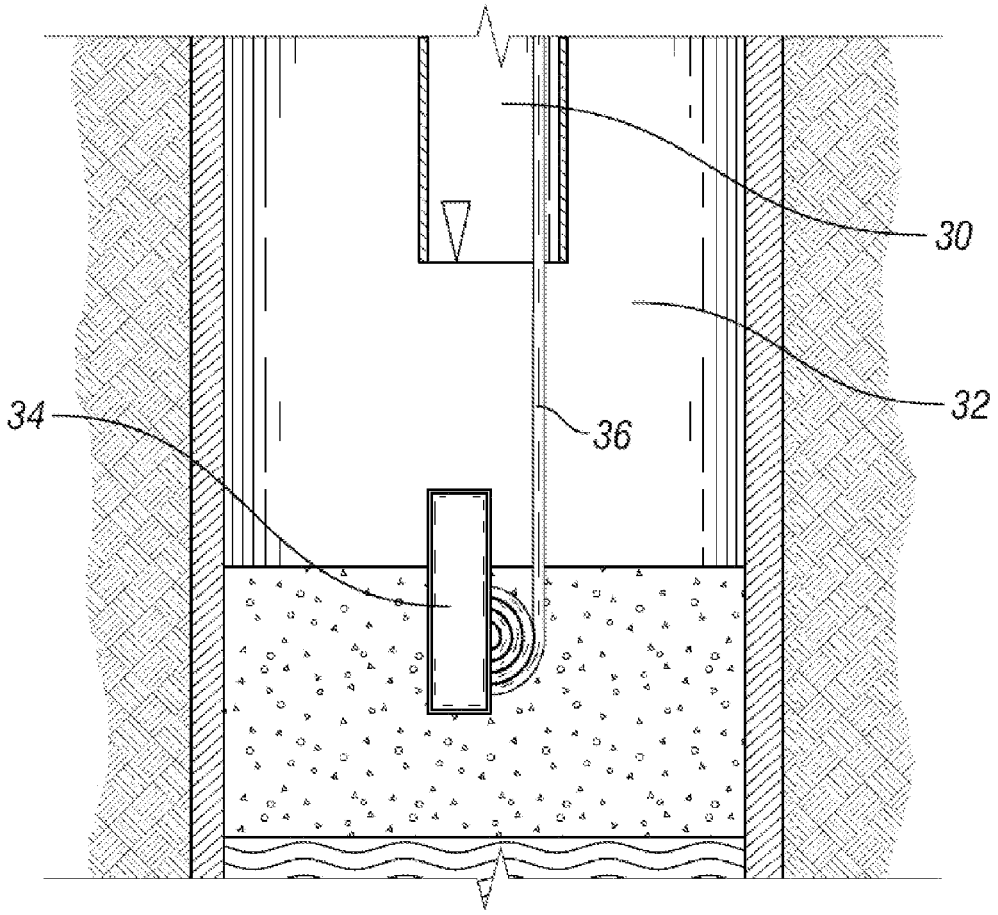
FIG. 4 shows the retraction of the wired placement conduit and unrolling of the communication wire.

FIG. 4 shows the retraction of the wired placement conduit 30 and unrolling of the communication wire 36; this occurs in response to the reception of the pressure pulse. When the sensor package 34 is released the wired pipe 30 is progressively pulled out of the hole 32. The communication wire 36 unrolls until it reaches the surface. The communication wire 36 may be an electrical wire, a fibre optic or a combination of both.

Figure 5:
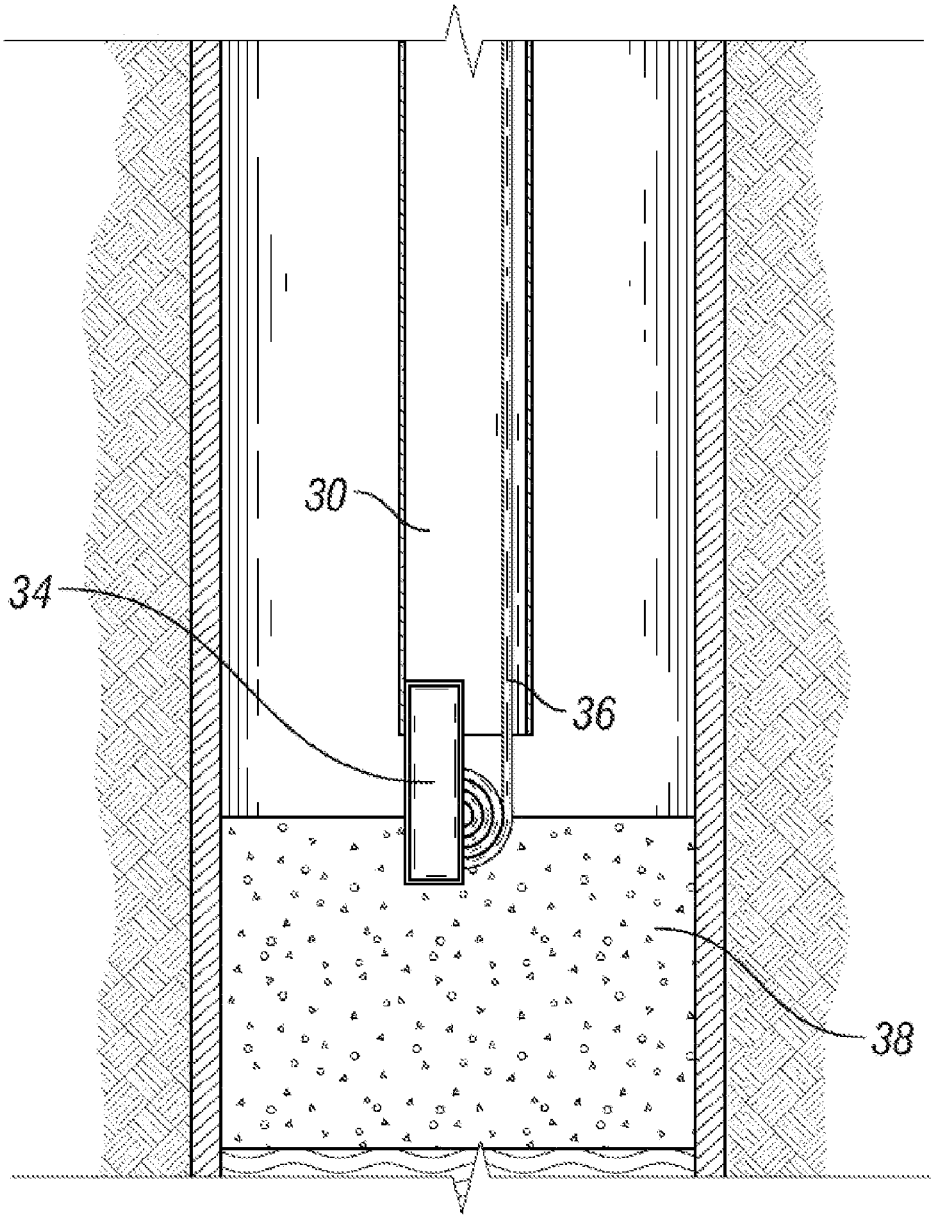
FIG. 5 shows an alternative embodiment whereby the wired placement conduit is only partially retracted.

FIG. 5 shows an alternative embodiment of the invention whereby the wired placement conduit 30 may only be pulled up a certain distance to ensure that the end is clear of the setting material 38 while the sensor package 34 remains in contact with it. The communication wire 36 connects to the wired placement conduit 30 and the signal is transmitted through the wired placement conduit 30 to the surface. This embodiment eliminates the need to retract the wired placement conduit 30 completely to the surface.

Figure 6:
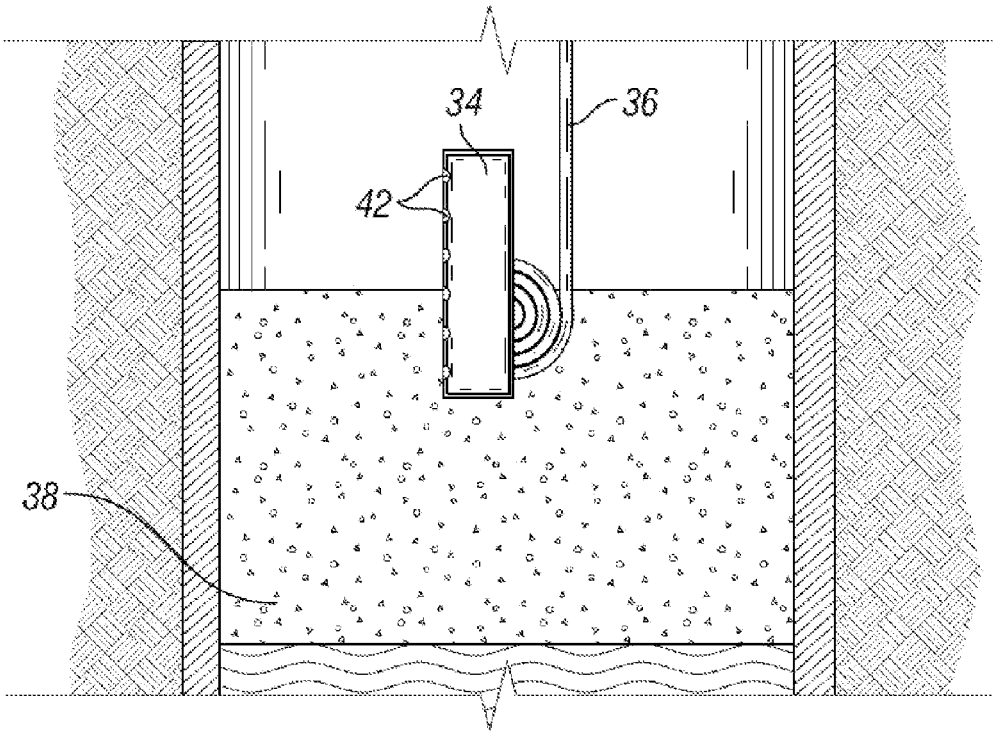
FIG. 6 shows the sensor package released and deployed to the cement plug.

FIG. 6 shows the sensor package 34 released and deployed to the cement plug 38. The sensor package 34 is capable of measuring downhole properties. These include but are not limited to; temperature, viscosity, density, pH, differential pressure, elastic modulus and acoustic impedance. The sensor package 34 may comprise multiple sensors 42 distributed along the cement plug length.

Figure 7:
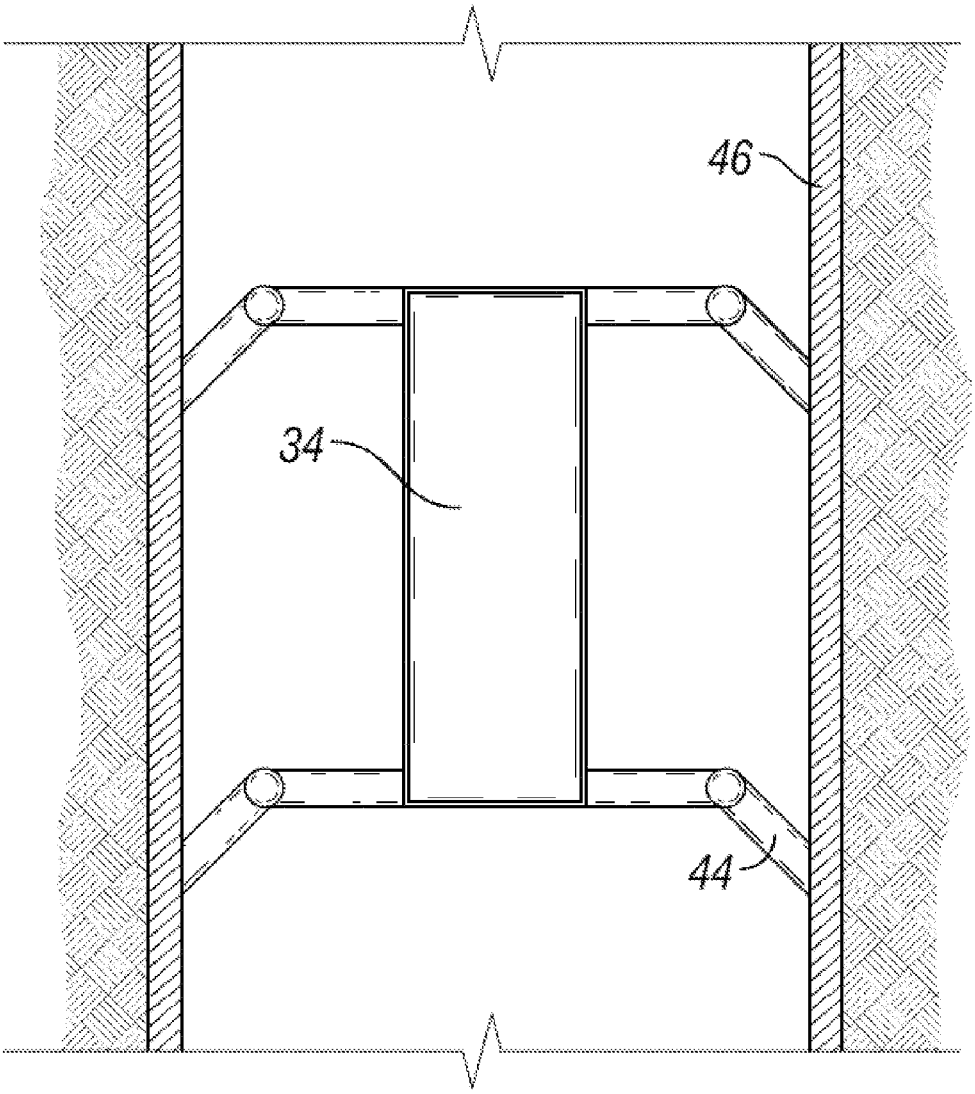
FIG. 7 shows the sensor package being secured to the well casing by means of a securing device.

FIG. 7 shows the sensor package 34 being secured to the borehole 32 at the required depth by means of a securing device. The deployment of anchoring arms 44 permits contact to be made with the well casing 46 to hold the package 34 in place. This avoids the package sinking out of the plug or rising to its surface, or becoming displaced by contact with other equipment.

Other changes can be made within the scope of the invention.

The invention claimed is:

1. An apparatus for placing a cement plug in a well, comprising:

a pipe for delivering a cement slurry to a predetermined location in the well to be plugged;

a cable fastened to a lower end of the pipe;

at least one differential pressure sensor attached to the lower end of the pipe and to the cable and operable to measure parameters in the well at the predetermined location;

a slurry placement device that activates release of the sensor from the pipe and enables the wire to unroll when the pipe is retracted from the predetermined location; and an operating system attached to the cable and located at the surface for receiving output signals from the sensor; wherein the sensor is configured to perform real-time measurements of at least one parameter relevant to cement plug placement.

2. The apparatus as in claim 1, wherein the sensor measures the viscosity of fluids in the well at the predetermined location.

3. The apparatus as claimed in claim 1, wherein the differential pressure sensor comprises a distributed differential pressure sensor for measuring pressure in an annulus outside the pipe in the well to evaluate the density of the fluids therein.

4. The apparatus as claimed in claim 1, wherein the differential pressure sensor measures the difference in pressure between the inside of the pipe and an annulus outside the pipe in the well.

5. The apparatus of claim 1, wherein the sensor comprises a temperature sensor.

6. A method of placing a cement plug in a well, comprising:

providing a pipe for delivery of the cement plug with a sensor attached to the end of the pipe and a communication wire attached to the sensor;

introducing the pipe into the well such that its end is at a predetermined location for placement of the plug;

launching a slurry placement device;

activating the release of the sensor and the communication wire from the pipe with the slurry placement device;

retracting the pipe from the predetermined location;

unrolling the communication wire while retracting the pipe; and operating the sensor to perform real-time measurements of at least one parameter relevant to cement plug placement in the well at the predetermined location;

sending output signals from the sensor to an operating system located at the surface, the operating system connected to the communication wire; and pumping cement through the pipe to the predetermined location;

wherein the step of operating the sensor comprises obtaining a differential pressure measurement in the fluids in the well at the predetermined location.

7. The method of claim 6, wherein the step of operating the sensor comprises making a temperature measurement.

8. The method as claimed in claim 6, wherein operating the sensor comprises measuring a density of fluids at the predetermined location.

9. The method of claim 8, wherein operating the sensor comprises making a temperature measurement.

10. The method as claimed in claim 6, wherein obtaining pressure measurements comprises making a distributed differential pressure measurement in an annulus in the well outside the pipe to determine the density of fluids in the annulus.

11. The method of claim 10, wherein operating the sensor comprises making a temperature measurement.

12. The method as claimed in claim 6, wherein making the differential pressure measurement comprises measuring the pressure difference between an inside and an outside of the pipe when located in the well.

13. The method of claim 12, wherein the step of operating the sensor comprises making a temperature measurement.

14. A method for of placing a cement plug in a well, comprising:

providing a pipe for delivery of the cement plug with sensors attached to the end of the pipe and a communication wire attached to the sensors;

introducing the pipe into the well such that its end is at a predetermined location for placement of the plug;

launching a slurry placement device that activates release of the sensors from the pipe;

activating the release of the sensor and the communication wire from the pipe with the slurry placement device;

retracting the pipe from the predetermined location;

unrolling the communication wire while retracting the pipe; and operating the sensors to perform real-time measurements of at least one parameter relevant to cement plug placement in the well at the predetermined location;

sending output signals from the sensors to an operating system located at the surface, the operating system attached to the communication wire; and pumping cement through the pipe to the predetermined location;

wherein operating the sensors comprises obtaining a differential pressure measurement in the fluids in the well at the predetermined location and obtaining a temperature measurement.

15. The method of claim 14, wherein operating the sensor comprises measuring a density of fluids at the predetermined location.

16. The method of claim 14, wherein obtaining pressure measurements comprises making a distributed differential pressure measurement in an annulus in the well outside the pipe to determine the density of fluids in the annulus.

17. The method of claim 14, wherein making the differential pressure measurement comprises measuring the pressure difference between an inside and an outside of the pipe when located in the well.

18. The method of claim 14, wherein the sensors further measure fluid viscosity in the well at the predetermined location.

19. The method of claim 14, wherein a differential pressure sensor measures a pressure difference between an inside of the pipe and an annulus outside the pipe in the well.

20. The method of claim 14, wherein the temperature is measured using a temperature sensor.

* * * * *